US007784587B2

(12) United States Patent
Zablocky

(10) Patent No.: US 7,784,587 B2
(45) Date of Patent: Aug. 31, 2010

(54) CONTROLLER COMBINATION FOR A VEHICLE LIFT

(75) Inventor: Michael Zablocky, Wyoming, PA (US)

(73) Assignee: Pride Mobility Products Corporation, Exeter, PA (US)

( * ) Notice: Subject to any disclaimer, the term of this patent is extended or adjusted under 35 U.S.C. 154(b) by 393 days.

(21) Appl. No.: 11/975,262

(22) Filed: Oct. 18, 2007

(65) Prior Publication Data

US 2009/0105904 A1 Apr. 23, 2009

(51) Int. Cl.
*B66F 9/20* (2006.01)

(52) U.S. Cl. ..... 187/224; 187/223

(58) Field of Classification Search ..... 187/222, 187/223, 224, 226, 277, 391–393
See application file for complete search history.

(56) References Cited

U.S. PATENT DOCUMENTS

| | | | | |
|---|---|---|---|---|
| 4,797,042 | A | 1/1989 | McFarland | 410/3 |
| 4,809,359 | A | 2/1989 | Dockery | 455/603 |
| 4,904,916 | A | 2/1990 | Gisske et al. | 318/649 |
| 4,984,955 | A * | 1/1991 | McCullough | 414/546 |
| 6,202,799 | B1 * | 3/2001 | Drop | 187/388 |
| 6,223,160 | B1 * | 4/2001 | Kostka et al. | 704/275 |
| 6,223,364 | B1 * | 5/2001 | Egan | 5/81.1 R |
| 6,382,363 | B1 * | 5/2002 | Friedli | 187/384 |
| 6,461,097 | B1 | 10/2002 | Ablabutyan et al. | 414/546 |
| 6,558,106 | B2 | 5/2003 | Sardonico | 414/556 |
| 6,705,824 | B2 | 3/2004 | Ablabutyan et al. | 414/546 |
| 6,868,945 | B2 * | 3/2005 | Schuster et al. | 187/380 |
| 6,986,408 | B2 * | 1/2006 | Takeuchi | 187/380 |
| 7,377,364 | B2 * | 5/2008 | Tyni et al. | 187/380 |
| 2005/0105995 | A1 | 5/2005 | Freet et al. | 414/541 |
| 2005/0238471 | A1 | 10/2005 | Ablabutyan et al. | 414/546 |
| 2006/0103209 | A1 | 5/2006 | Olcheski | 297/330 |

* cited by examiner

*Primary Examiner*—Jonathan Salata
(74) *Attorney, Agent, or Firm*—Flaster/Greenberg P.C.

(57) ABSTRACT

A control system for a vehicle lift apparatus is provided, having an infrared wireless controller and a wired controller for operating the lift. The wired controller includes an infrared sensor for receipt of the signals from the wireless controller. The wired controller is removably attached to the vehicle lift apparatus in a position normally capable of receiving the infrared control instructions.

5 Claims, 9 Drawing Sheets

CONTROLLER COMBINATION FOR A VEHICLE LIFT

FIELD OF THE INVENTION

The present invention relates to a vehicle lift apparatus. More specifically, the invention contemplates a control system that uses both a wired controller and a wireless controller to send control instructions to the vehicle lift.

BACKGROUND OF THE INVENTION

Persons of limited mobility often use motorized vehicles to assist in day-to-day activities. Often these vehicles must be transported in an automobile or the like. One common way of moving the vehicle into and out of the automobile is a powered-lifting device having a support platform. These lifting devises often have control systems to instruct the motors that operate the lift systems. The control system can be hard wired or wireless. Remote control systems that use infrared type wireless controllers must implement an infrared receiving window in the line of sight of the remote control. If the infrared window is not in the line of sight, the remote control must be relocated in order to operate the lift apparatus. Use of the hard wired controller is restricted by the length of the connecting wire.

U.S. Pat. No. 6,223,364 to Egan shows a lifting and transferring apparatus for assisting persons on entering and exiting a vehicle. The lifting apparatus is controlled by a control unit indicated to be either a wireless remote control unit and/or a hard wired control modular control unit.

U.S. Pat. No. 4,984,955 to McCullough shows a lifting apparatus for use with a vehicle or adjacent horizontal raised platform. A wireless controller communicates with the control module attached to the upper portion of the lift frame. A wired controller is also connected to the control module.

U.S. Pat. No. 4,904,916 to Gisske et al., shows a residential stairway lift having a stationary motor drive unit, a mobile platform moving along a stairway and a user interface. The mobile platform communicates with the motor drive unit through a continuous broad beamed infrared link. The motor drive unit communicates with the mobile platform through an intermittently established short-range infrared link. There is also a user interface in the form of a hard wired controller monitored on an adjacent wall.

SUMMARY OF THE INVENTION

The present invention relates to a control system for a vehicle lift adapted for moving a vehicle between a ground plane and a raised platform. The control system includes an infrared wireless controller and a wired controller for transmitting control instructions to the motor for operating the lift. The wired controller is connected to the main control system by a flexible wire. The wired controller includes a means for inputting control instructions. The wired controller further includes an infrared sensor for receiving infrared control instructions from a infrared controller and transmitting the control instructions to the main control system. The wired controller has an attachment structure for removably attaching the controller to the vehicle lift apparatus in a position normally capable of receiving the infrared control instructions.

A vehicle lift apparatus combined with the control system may include a track and slide secured to the raised platform of the structure, a lift frame for moving between an up and a down position below the track, and a motor for moving the slide and the lift frame pursuant to electrical control instructions.

BRIEF DESCRIPTION OF THE DRAWINGS

For the purpose of illustrating the invention, the drawings show forms of the invention that are presently preferred. However, it should be understood that the invention is not limited to the precise arguments and instrumentalities shown in the drawings.

DETAILED DESCRIPTION OF THE DRAWINGS

Figure 1:
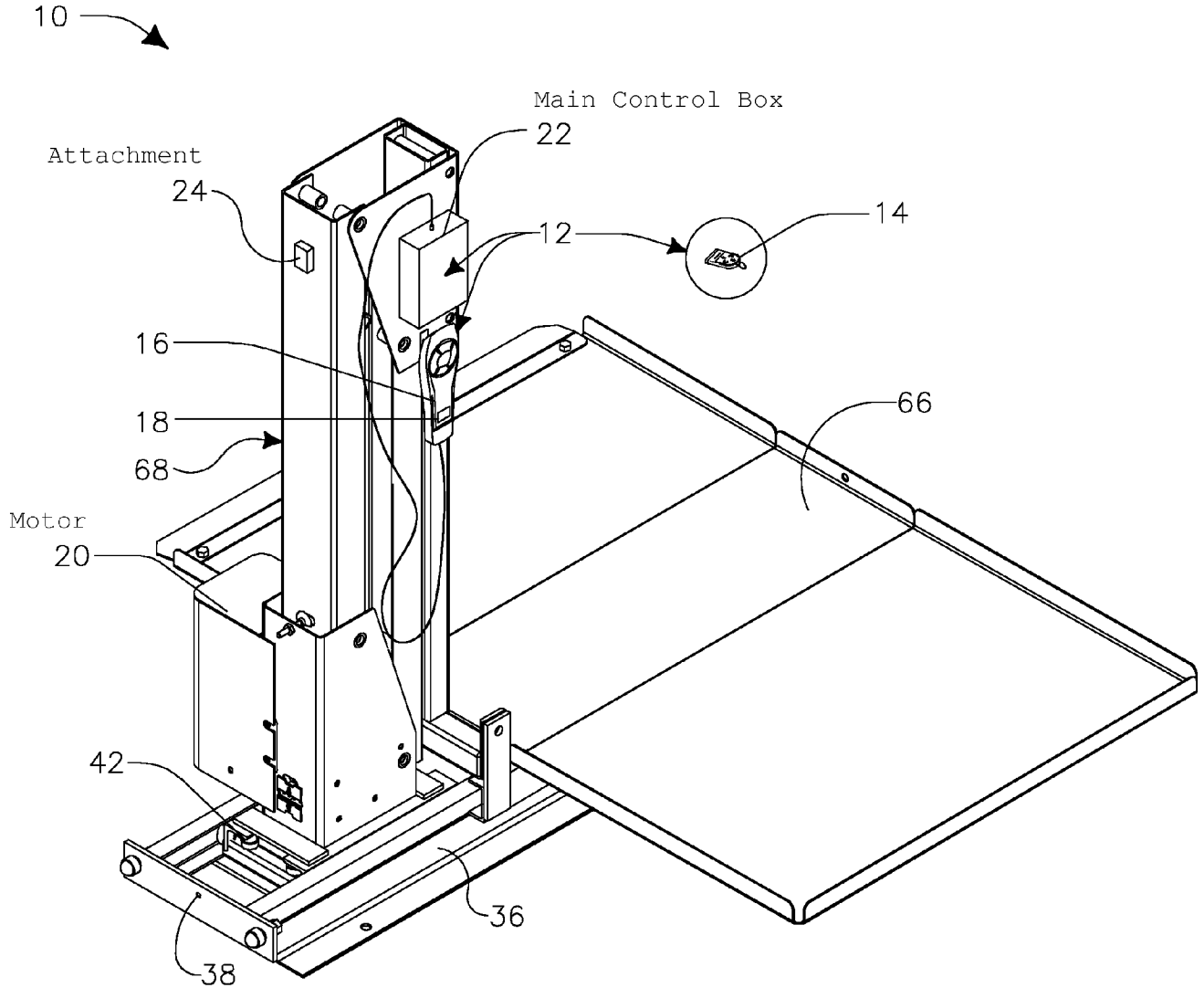
FIG. 1 is a perspective view of an embodiment of a vehicle lift apparatus shown in FIG. 1.

Referring now to the drawings wherein like numerals indicate like elements, there is shown an exemplary embodiment of a vehicle lift as contemplated by the present invention. The apparatus is generally referred to by the numeral 10. The lift 10 is contemplated to be used along with an automobile to lift vehicles designed for persons of limited mobility, such as power wheelchairs and scooters, for temporary storage within the automobile. However, such lifts may also be used at fixed locations, such as platforms and stairs, and used to lift almost any type vehicle, such as motorcycles or off-road vehicles, or other articles.

Figure 2:
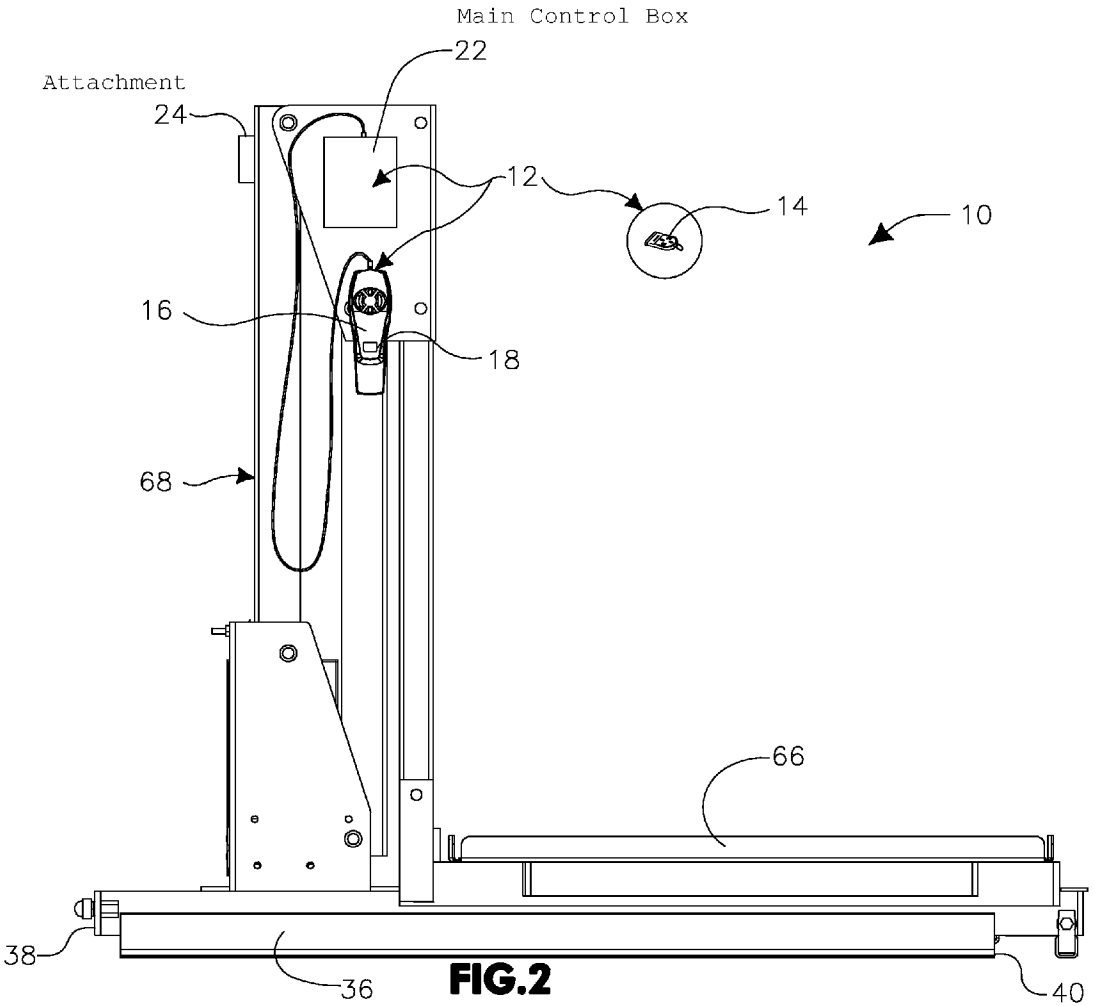
FIG. 2 is a side elevation view of the vehicle lift apparatus shown in FIG. 1.
Figure 3:
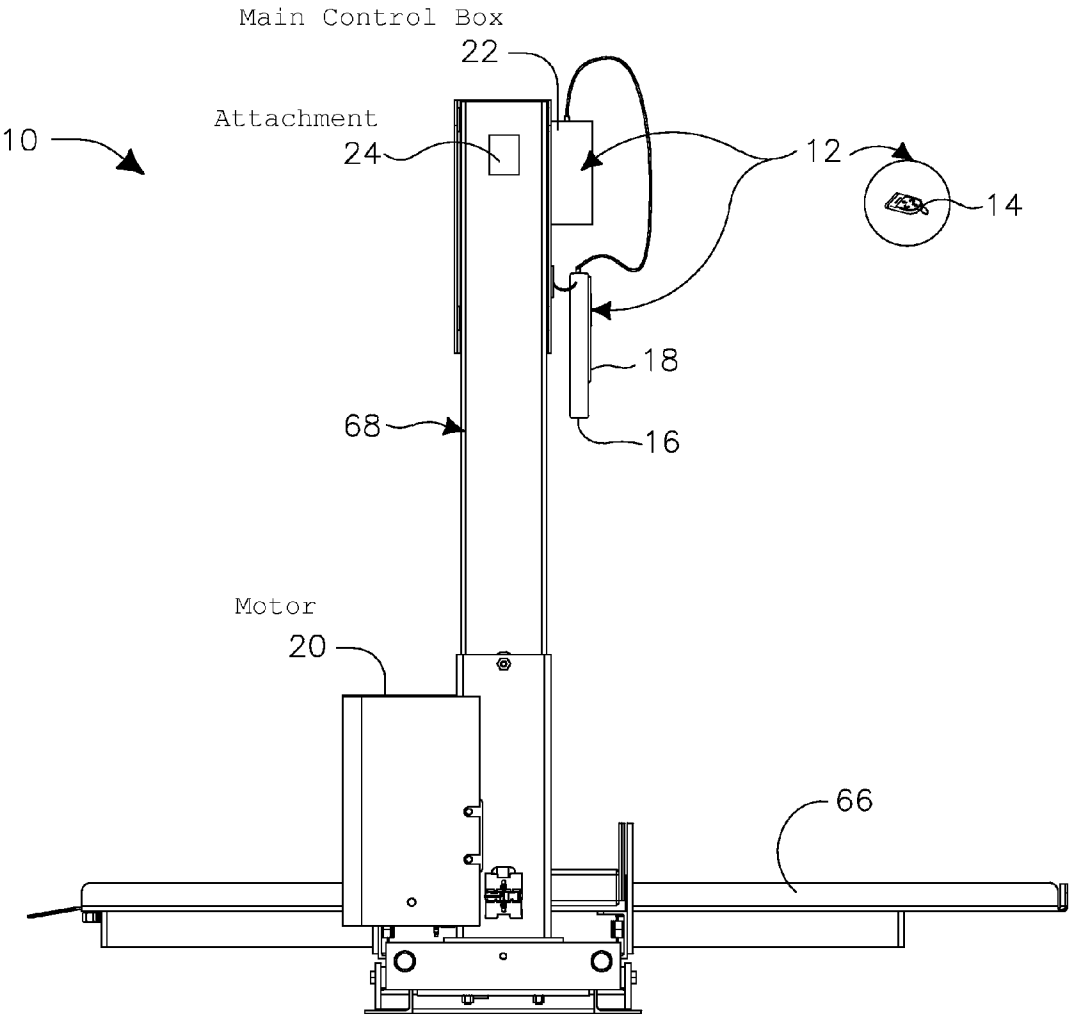
FIG. 3 is a rear elevation view of the vehicle lift apparatus of FIGS. 1 and 2.

FIGS. 1-3 show an exemplary embodiment of a control system 12 for the vehicle lift 10. As illustrated, the control system 12 includes a wireless controller 14 for transmitting control instructions, a wired controller 16 for transmitting control instructions over a flexible wire, and a main control system 22.

Figure 4:
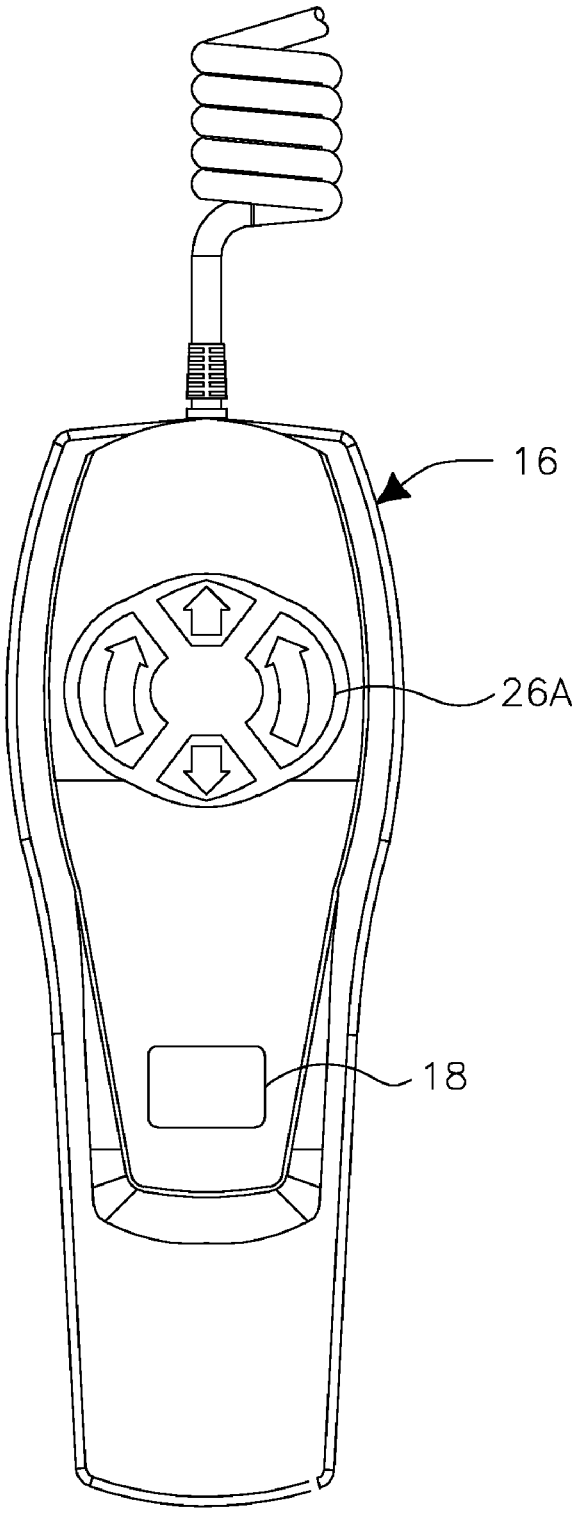
FIG. 4 is a top plan view of a wired controller portion of the vehicle lift apparatus of FIGS. 1-3.

As shown in FIG. 4, the wired controller 16 includes a control pad 26A to facilitate a user's operation of the vehicle lift apparatus 10. As shown in FIG. 4, the control pad 26 includes four buttons, each for activating a specific operation of the lift 10. However, the control pad 26A can have more or less buttons and may also include dials, keypads, or any other control activation means known in the industry. The wired controller 16 sends control instructions through the wire to the main control box, which in turn transmits an operational signal to the motor to operate the lift 10.

Figure 5:
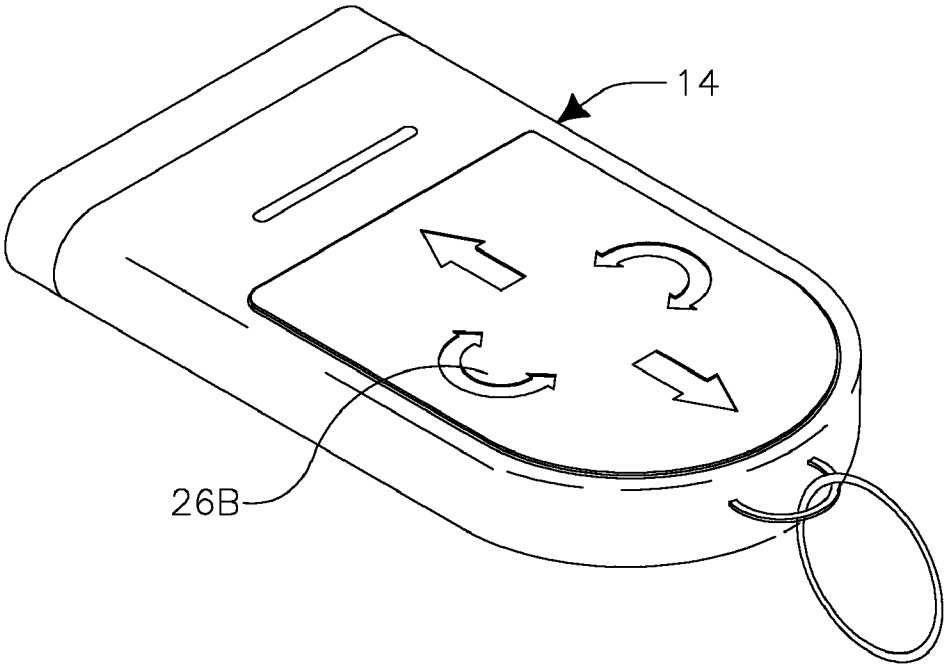
FIG. 5 is an enlarged perspective view of a remote controller portion of the vehicle lift apparatus of FIGS. 1-3.

Referring to FIG. 5, the wireless controller 14 includes a control pad 26B to allow a user to send infrared control instructions through the infrared wireless controller 14. As shown, the control pad 26 includes four buttons with each button having a distinct operational control signal associated therewith. However, the control pad 26 may have other combinations of buttons, dials, key pads, or any other control structure known in the industry. The wired controller 16 includes an infrared sensor 18 located for receiving infrared control instructions from the wireless controller 14 and transmitting the control instructions to the main control box 22.

Figure 2A:
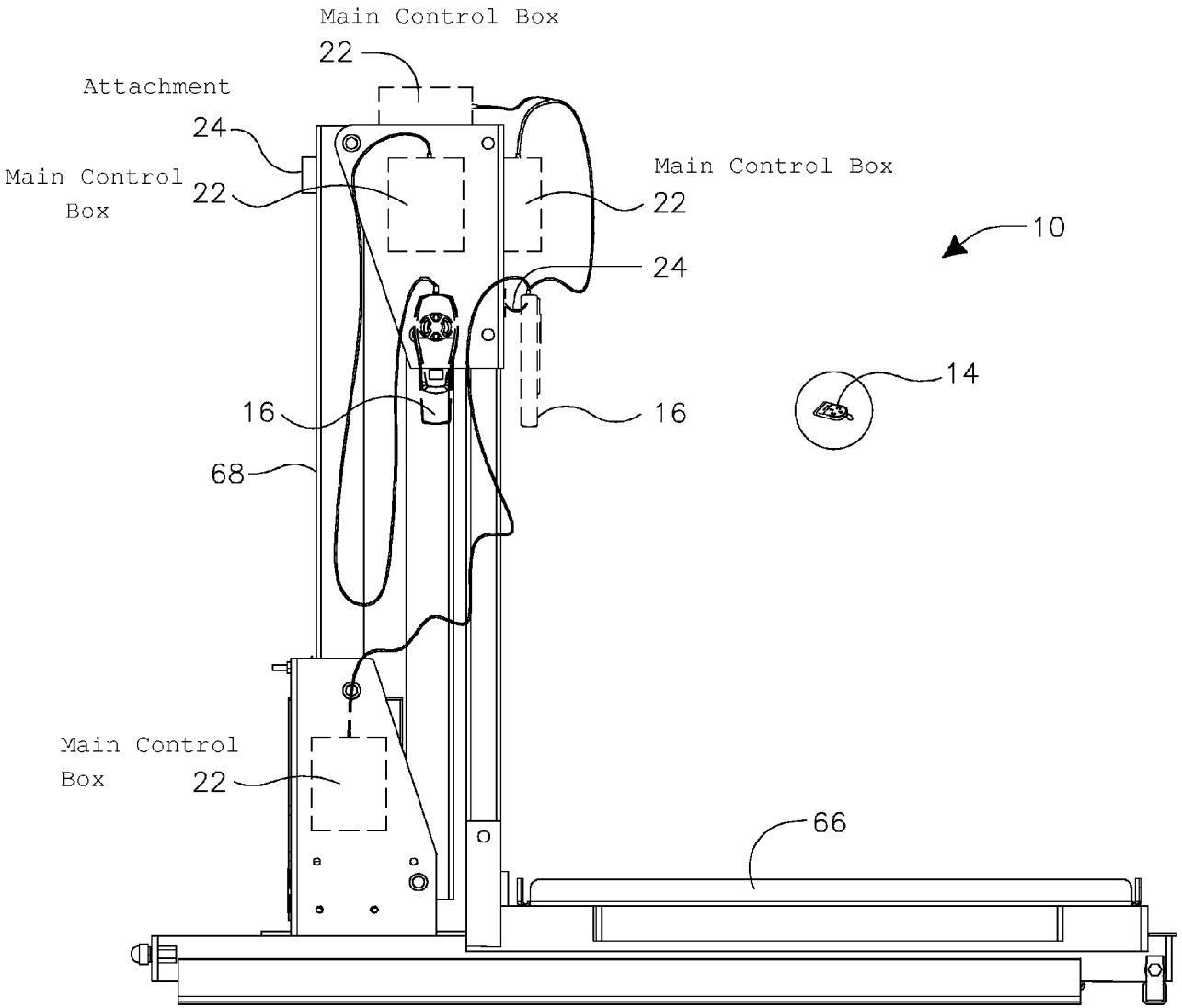
FIG. 2A is a side elevation view of the vehicle lift apparatus of the present invention showing alternative positions for a fixed infrared sensor and a wired controller.

The control system 12 also includes an attachment structure 24 for removably attaching the wired controller 16 to the lift 10. The wired controller 16 is preferably positioned in a location normally capable of receiving the infrared control instructions from the wireless controller 14. For example, as shown in FIGS. 1 and 2, the attachment structure 24 is located high on the lift 10. Thus, the wired controller 16 is attached away from the ground plane where objects or part of the lifting structure may obstruct the path of the infrared control signal. The wired controller 16 may be placed at any number of positioned as is shown in FIG. 2A. Similarly, the main control box 22 can also be placed at various positions. The attachment structure 24 can be any device known in the industry, such as one or more hooks, fasteners, hook and loop fasteners, burr fasteners, touch fasteners, knobs, etc. Moreover, although the attachment structure 24 shown in FIGS. 1-3 is connected to the vehicle lift apparatus 10, the attachment structure 24 can be primarily located on the casing of the wired controller 16. For example, the hook shown in FIGS. 1-3 can be attached to the casing of the wired controller 16, and a loop or notch can be attached to the lift 10.

The control system 12 may further include a fixed sensor 24 attached to the lift 10 for receiving the infrared control signals and transmitting them directly to the control box 22. Preferably, the fixed sensor 24, like the wired controller 16, is attached in the position normally capable of receiving the infrared control signal. For example, as shown in FIGS. 1-3, the fixed sensor 22 can be positioned high on the lift 10. Depending on the type of vehicle or the form of the lift, the position of the wired controller 16 and the fixed sensor 24 can be changed.

Figure 6A:
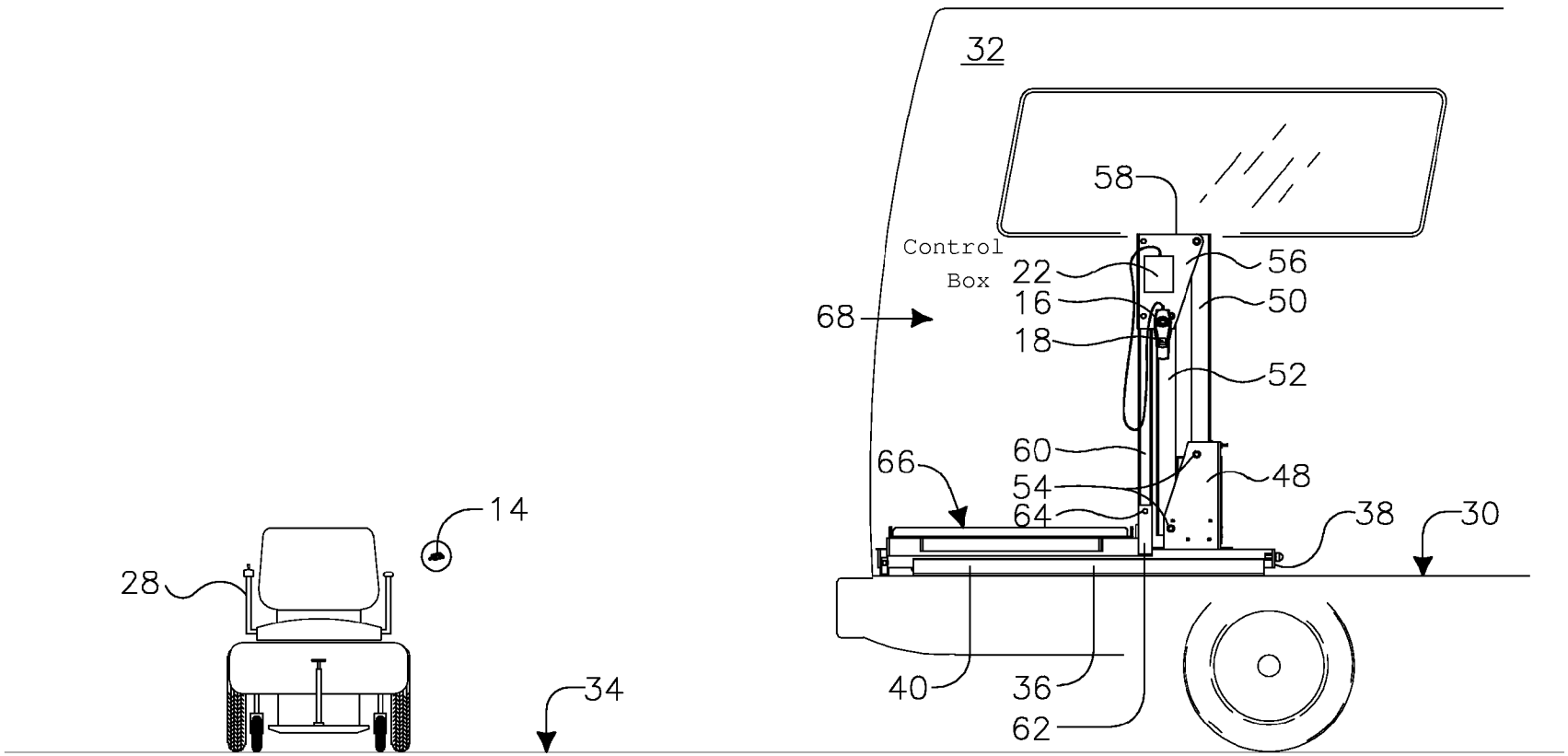
FIG. 6A is an elevation view of the vehicle lift apparatus of the present invention in relation to an automobile in which the vehicle is to be stored.
Figure 6B:
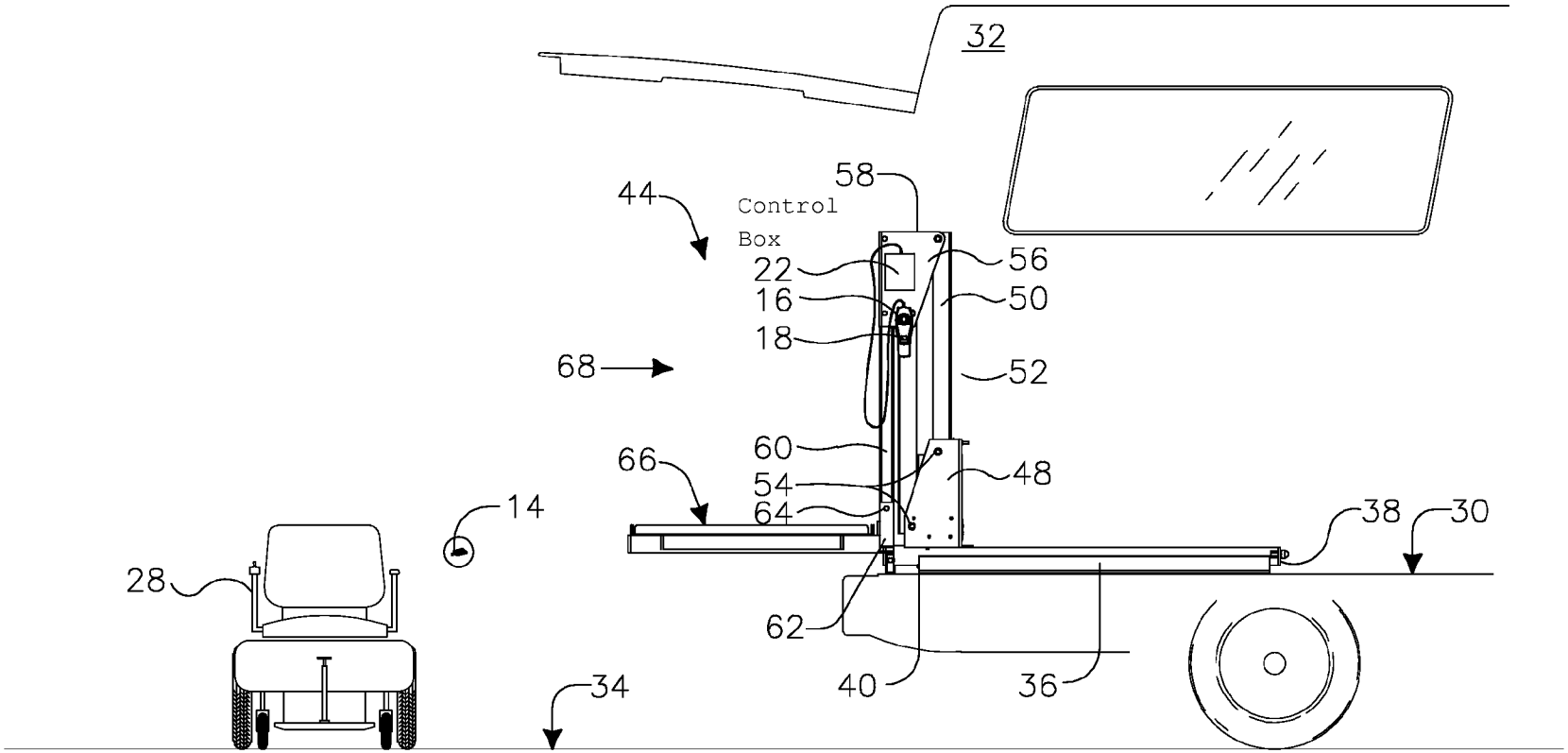
FIG. 6B is an elevation view of the vehicle lift apparatus of the present invention in the lowered/receiving portion.
Figure 6C:
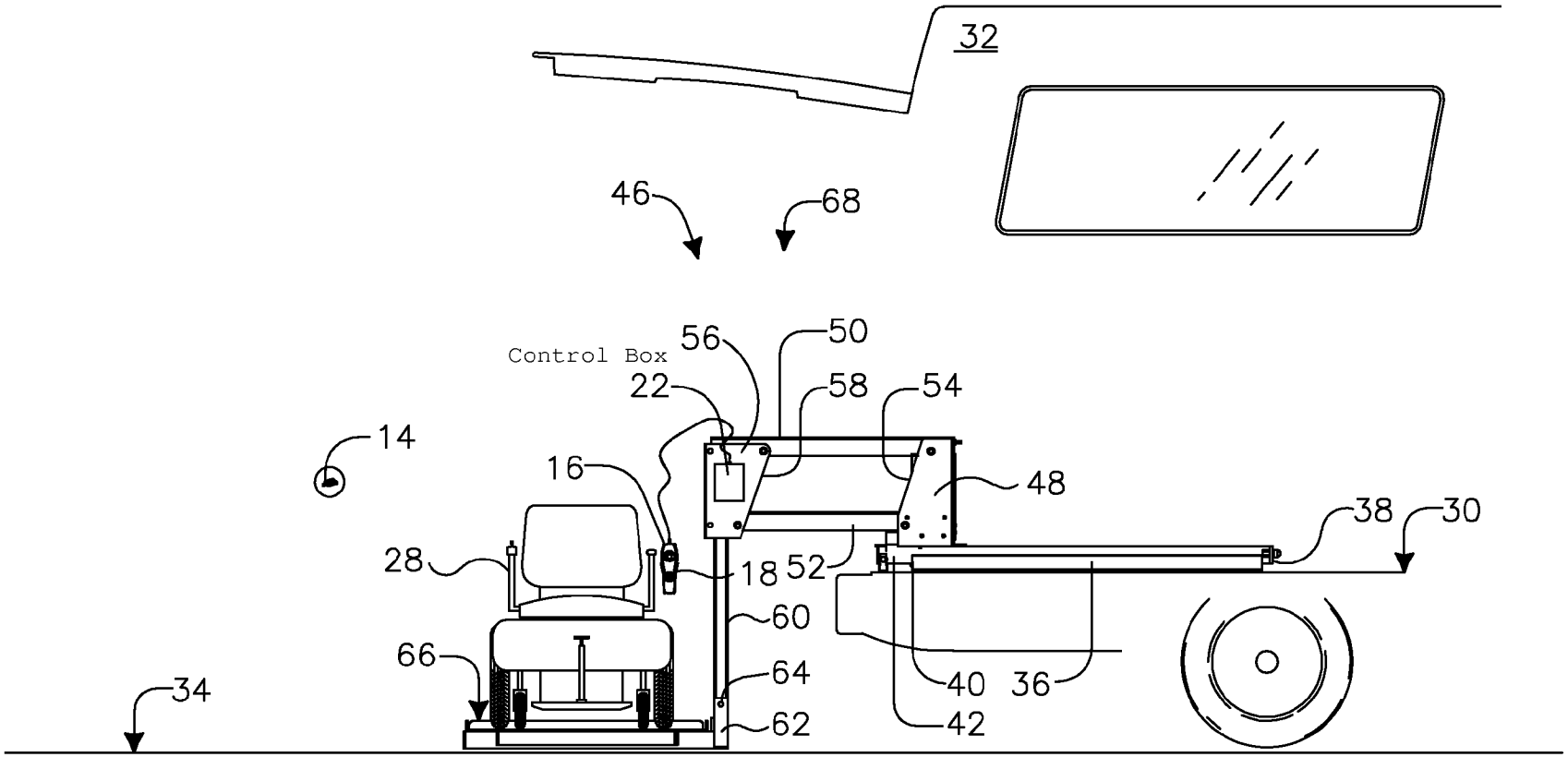
FIG. 6C shows an elevation view of the system of the vehicle lift apparatus in the ready portion for raising a vehicle.

Referring now to FIGS. 6A-6C, the lift 10 and control system 12 are shown in operation for moving a vehicle 28 into the raised platform 30 of an automobile 32. Although an automobile 32 is shown, the lift can be used with any structure having a raised platform, such as stairs, a stage, a deck, a building floor, or the like.

The lift 10 includes a track 36, which is secured to the raised platform 30 of the automobile 32. The track 36 includes an inside end 38 and an outside end 40. The inside end 38 is located away from an edge or the side of the raised platform 30. The outside end 40 of the track 36 is located toward the edge or side of the raised platform 30. The lift 10 also includes a slide 42, which is secured to the track 36. The slide 42 moves between the inside end 38 and outside end 40 of the track 36.

The vehicle lift apparatus 10 also includes a lift frame 68, which is attached to the slide 42. The lift frame 68 moves between the inside end 38 of the track 36 (FIG. 6A) to the outside end 40 of the track 38 (FIGS. 6B-6C). The lift frame 68 also moves between an up position (FIGS. 6A and 6B) and a down position (FIG. 6C). A motor 20 is provided for moving the slide 42 and the lift frame 68. The motor 20 operates upon receipt of control instructions from the control box 22. The multiple motors may also be provided to perform the various lift movements.

As shown in FIGS. 6A-6C, the lift frame 68 includes a first support plate 48 secured to the slide 42. A first arm 50 and a second arm 52 are secured to the first support plate 48 at a first end 54. The lift frame 68 also includes a second support plate 56 at a second end 58 of the arms 50, 52. In this contemplated embodiment, the first arm 50 and the second arm 52 remain substantially parallel when the lift 10 moves between the up position (FIG. 6A-6B) and the down position (FIG. 6C).

A third arm 60 is secured to the second support plate 56 at one end 58 and to a support plate 62 at the opposite end 64 of the arm 60. In the contemplated embodiment, the third arm 60 remains substantially vertical when moving between the up position (FIGS. 6A and 6B) and the down position (FIG. 6C). The lift platform 66 remains perpendicular to the third support arm 62. Although the aforementioned embodiment is contemplated, any embodiment of the lift frame 68 suitable to move a vehicle 28 between a ground plain 34 and a raised platform 30 can be used with the disclosed system. Moreover, although the vehicle 28 shown in the system is a wheelchair, any suitable vehicle can be used including, but not limited to, scooters, motorcycles and off-road vehicles.

The invention has been described and illustrated with respect to the exemplary embodiments thereof. It should be understood by those skilled in the art that the foregoing and various other changes, omissions and additions may be made therein and thereto, without parting from the spirit and scope of the present invention.

What is claimed is:

1. A control system for a vehicle lift apparatus, comprising:

a main control box for receiving control signals and for transmitting control instructions for operation of the vehicle lift;

a remote infrared wireless controller for transmitting infrared control signals to the main control box; and a remote wired controller for transmitting control signals to the main control box, the wired controller connected to the main control system by a flexible wire over which the control signals are transmitted from the wired controller to the main control box, the wired controller further comprising an infrared sensor for receiving infrared control signals from the infrared wireless controller and transmitting the control signals over the flexible wire to the main control box, and means for removably attaching the wired controller to the vehicle lift apparatus.

2. A vehicle lift comprising:

a lifting frame, a support platform, a supporting track secured to a structure comprising a slide, and a drive motor for moving the lifting frame and the support platform along the track and between an up position and a down position, the drive motor being responsive to electrical control instructions; and a control system comprising a main control box for receiving control signals and for transmitting control instructions for operation of the drive motor;

a wireless controller for transmitting wireless control signals;

a wired controller for transmitting control signals via a flexible wire connected to the main control box, the wired controller comprising a sensor for receiving wireless control signals and for transmitting the control signals to the main control box, and means for removably attaching the wired controller to the vehicle lift in a position normally capable of receiving the wireless control signals from the wireless controller.

3. The vehicle lift of claim 2 further comprising a fixed sensor positioned on the lifting frame for receiving wireless control signals from the wireless controller and transmitting the control signals to the main control box.

4. The vehicle lift of claim 2, wherein the lifting frame further comprises:

a first support plate secured to the slide;

a first arm and a second arm pivotably secured to the first support plate at a first end;

a second support plate pivotably secured to the first and second arms at a second end thereof, wherein the first arm and the second arm remain substantially parallel when the vehicle lift moves between the up position and the down position; and a third arm secured to the second support plate at one end, wherein the third arm remains substantially vertical when the vehicle lift moves between the up position and the down position;

the support platform perpendicularly secured to the third arm.

5. The vehicle lift of claim 2 wherein the wireless controller emits infrared control signals and the sensor receives infrared control signals.

* * * * *